US006793548B2

(12) United States Patent
Jolly et al.

(10) Patent No.: US 6,793,548 B2
(45) Date of Patent: Sep. 21, 2004

(54) SPORTBOARD FIN ATTACHMENT SYSTEM

(75) Inventors: Barry A. Jolly, Burleigh Heads (AU); Carl B. Zich, Sr., Riverside, CA (US)

(73) Assignee: OAM, LLC, Oceanside, CA (US)

( * ) Notice: Subject to any disclaimer, the term of this patent is extended or adjusted under 35 U.S.C. 154(b) by 0 days.

(21) Appl. No.: 10/656,773

(22) Filed: Sep. 4, 2003

(65) Prior Publication Data

US 2004/0043681 A1 Mar. 4, 2004

Related U.S. Application Data

(63) Continuation-in-part of application No. 10/155,287, filed on May 23, 2002, now Pat. No. 6,752,674.

(51) Int. Cl.[7] ..... B63B 1/00

(52) U.S. Cl. ..... 441/79

(58) Field of Search ..... 441/79, 74; 114/140

(56) References Cited

U.S. PATENT DOCUMENTS 4,421,492 A * 12/1983 Leva ..... 441/79

* cited by examiner

*Primary Examiner*—Ed Swinehart
(74) *Attorney, Agent, or Firm*—Kenneth J. Hovet

(57) ABSTRACT

A fin and tag are formed from a unitary structure. The tag releasably secures to a tag engagement member embedded in a sportboard. A tag-pin extends through the tag about perpendicular to the longitudinal axis of the tag with first and second tag-pin ends extending outward from the tag. The engagement member has a longitudinal center slot for receiving the tag, and at least one bilateral slot intersecting the longitudinal center slot for allowing passage of the tag-pin as the tag is inserted in the center slot. The first and second tag-pin ends are respectively secured in first and second clamping engagements disposed on opposite sides of the center slot. Each clamping engagement is suspended by opposing flexible anti-torsion suspension members, and has elongated upper and lower clamping members between which a tag pin end is secured. Each clamping engagement is tightened and loosened by a cap screw and T-nut engagement.

22 Claims, 11 Drawing Sheets

SPORTBOARD FIN ATTACHMENT SYSTEM

CROSS REFERENCE TO RELATED APPLICATIONS

The present application is a Continuation-In-Part of U.S. patent application Ser. No. 10/155,287 filed May 23, 2002 now U.S. Pat. No. 6,752,674 and entitled SPORTBOARD FIN ATTACHMENT.

BACKGROUND OF THE INVENTION

1. Field of Invention

The present invention pertains generally to a device and method for adjustably attaching fins to a sportboard. The invention is particularly, but not exclusively, useful for attaching fins in a manner that allows for quick and convenient adjustment of the position of a fin on a sportboard to maximize the sportboard performance.

2. Description of Related Art

Sportboards, such as surfboard and sailboards, are well known in the prior art for providing recreational enjoyment. Typically, between one to four fins are attached to the underside of the board for facilitating stability and maneuverability. The fins have often been permanently mounted to the underside of the board.

However, there are several disadvantages to permanently mounting a fin to a board. Specifically, the fin cannot be easily removed and replaced if it becomes damaged. Further, the fin cannot be replaced with another fin having different performance properties. This would be advantageous if the user wishes to experiment with different fin configurations according to prevailing wind and surf conditions. Still further, a permanently mounted fin makes the surfboard unwieldy and difficult to transport. For the above reasons, it would be desirable to have fins that can be detachably mounted to the surfboard.

In addition to being detachable, it would be helpful to be able to adjust the position of a fin relative to the board when it is attached. In particular, to maximize the effectiveness of a fin for a variety of wind and surf conditions, it is important to be able to change the longitudinal position of the fin on the board. It is also desirable to be able to change the fin roll angle, i.e., the angle the fin makes with respect to the underside of the board. Additionally, it is important to be able to adjust the fin by hand or with a small tool which would fit within a swimming suit or a wetsuit pocket without causing any discomfort to the wearer.

U.S. Pat. No. 6,139,383, which issued to Barry A. Jolly et al for an invention entitled "Fin Assembly", discloses a fin attachment system wherein a mounting device having a front socket and a rear socket is embedded within a surfboard. A fin having predetermined projections are respectively inserted into the front socket and rear socket and fixed thereto by set screws. For the device as disclosed by Jolly et al, however, there is no tag slot or pin slot in the socket mounting to permit longitudinal movement or adjustment of the fin roll angle.

U.S. Pat. No. 5,997,376, which issued to Block et al for an invention entitled "Surfboard Fin Mounting System", discloses a fin that is adjustably attached to a box which is embedded within the surfboard. (The box is mounted in an opening cut into the surfboard.) The box includes a tag slot, but not a pin slot, and the fin is detachably fixed to the surfboard by passing a fastener through the top of the surfboard and threading the fastener into the fin. For the device disclosed by Block et al, however, the fin and tag lack versatility because they are a single integral unit. Further, the tag interfits within the tag slot in a manner which allows for longitudinal adjustment only. Additionally, it is undesirable to place an unsightly opening in the surfboard for installing a contrasting box which visibly extends through the surfboard.

U.S. Pat. No. 5,672,081, which issued to Whitty for an invention entitled "Surf Fin Fixing System", discloses a detachable fin wherein two spaced-apart tabs extend downwardly from the fin. The tabs are inserted into slots within a fixing element which is embedded in the surfboard and fixed thereto by a set screw which is obliquely inserted into the fixing element until it contacts a tab. However, Whitty does not envision any structure for adjusting the fin longitudinal position or fin roll angle. The main emphasis of Whitty is simply to provide a fin removal system.

SUMMARY OF THE INVENTION

In the light of the above, it is an object of the present invention to provide a sportboard fin attachment system that allows for quick and easy attachment and removal of the fin from the board. It is another object of the present invention to provide a sportboard fin attachment system that allows for adjustment of both longitudinal fin position and fin roll angle relative to the board. Yet another object of the present invention is to provide a sportboard fin attachment system wherein the user can adjust the longitudinal fin position and fin roll angle by hand or with a small implement which can be comfortably stowed in a swimsuit or wetsuit. Still another object of the present invention is to provide a sportboard fin attachment assembly which is easy to install on a sportboard and has significant durability. Another object of the present invention is to provide a sportboard fin attachment system which is easy to manufacture in a cost efficient manner.

As used herein, the term "sportboard" is intended to mean all types of boards used in water such as surfboards, wakeboards, sailboards and body boards. The term is also intended to encompass all types of water craft such as boats, kayaks, canoes and catamarans.

An alternative sportboard assembly comprises a sportboard with a with bilateral tag engagement unit and a tag fixed to a fin. The tag comprises first and second opposing surfaces and a tag-pin hole extending through the tag from the first to the second surface. A bilateral tag pin with a first and second end is disposed within the tag-pin hole. The first end protrudes beyond the first surface and the second end protrudes beyond the second surface. The tag is releasably secured to the bilateral tag engagement unit. The fin and tag are preferably integrally formed from a single member.

The sportboard has a longitudinal axis, and the tag-pin is about perpendicular to the longitudinal axis. The bilateral tag engagement unit has a first clamp for securing the first end of the tag-pin, and a second clamp for securing the second end of the tag-pin.

A first cap screw with a first threaded shaft controllably imparts a first force to the first clamp, and a second cap screw with a second threaded shaft controllably imparts a second force to the second clamp.

The bilateral tag engagement unit has a plug-base with first and second barrel guide holes respectively disposed beneath the first and second clamps. A first T-nut has a T-nut base disposed beneath the plug-base and a first threaded barrel attached to the base and extending through the first barrel guide hole. A second T-nut has a second T-nut base secured to a second threaded barrel. The second T-nut base is disposed below the plug base, and the second threaded barrel extends through the second barrel guide hole. The first and second threaded shafts of the cap screws are threadably engaged with the first and second threaded barrel respectively.

The first clamp is suspended between first and second flexible anti-torsion suspension members. The tension members exert a continual force on the first clamp, resulting in a lock washer effect on an engagement between the first threaded shaft and the first threaded barrel.

The first clamp comprises an elongated upper clamp member and an elongated lower clamp member separated by a pin slot. The upper and lower clamp members have a plurality of opposing ridges and grooves for engaging the first end of the tag-pin in a plurality of longitudinal positions. The first clamp can be slidably adjusted to any groove within the first pin slot. When the first securing member is engaged, the first tag pin becomes constrained in a predetermined groove within the first pin slot.

The second clamp comprises an elongated upper clamp member and an elongated lower clamp member separated by a pin slot. The upper and lower clamp members of the second clamp have a plurality of opposing ridges and grooves for engaging the second end of the tag-pin in a plurality of longitudinal positions. The second clamp can be slidably adjusted to any groove within the second pin slot. When the second securing member is secured, the first tag pin is secured in a predetermined groove within the first pin slot.

A center channel separates the first clamp from the second clamp. The center channel has a length and width sufficient for insertion of the tag in the center channel. The tag is tapered, and surfaces of the first and second clamp that face the center channel are tapered to snugly receive the tapered tag.

At least one pin slot intersects the center channel. The pin slot being sufficient size to allow passage of the tag-pin.

The tag engagement member includes a bilateral plug and a bilateral socket having a cavity into which the bilateral plug is fitted, and wherein the bilateral plug is a single contiguous member including the first clamp and the second clamp.

A method of releasably securing the fin to the sportboard comprises the followings steps: The first end of the tag-pin is inserted through the bore in the tag until the first end of the tag pin extends beyond the first side and the second end extends beyond the second side of the tag. The tag-pin is positioned above a select tag pin slot, and the tag is inserted into the center slot of the tag engagement member, thereby inserting the tag-pin through the select tag-pin slot and through the cross-slot pin guide. The tag is then slid longitudinally through the center slot of the tag engagement member, thereby sliding the first and second sides of the tag pin through the first and second pin slots respectively. When the first and second tag pins reach select locations within the respective first and second pin slots, the first cap screw is tightened into the first T-nut, and the second cap screw is tightened into the second T-nut, thereby securing the tag-pin within the tag engagement member.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
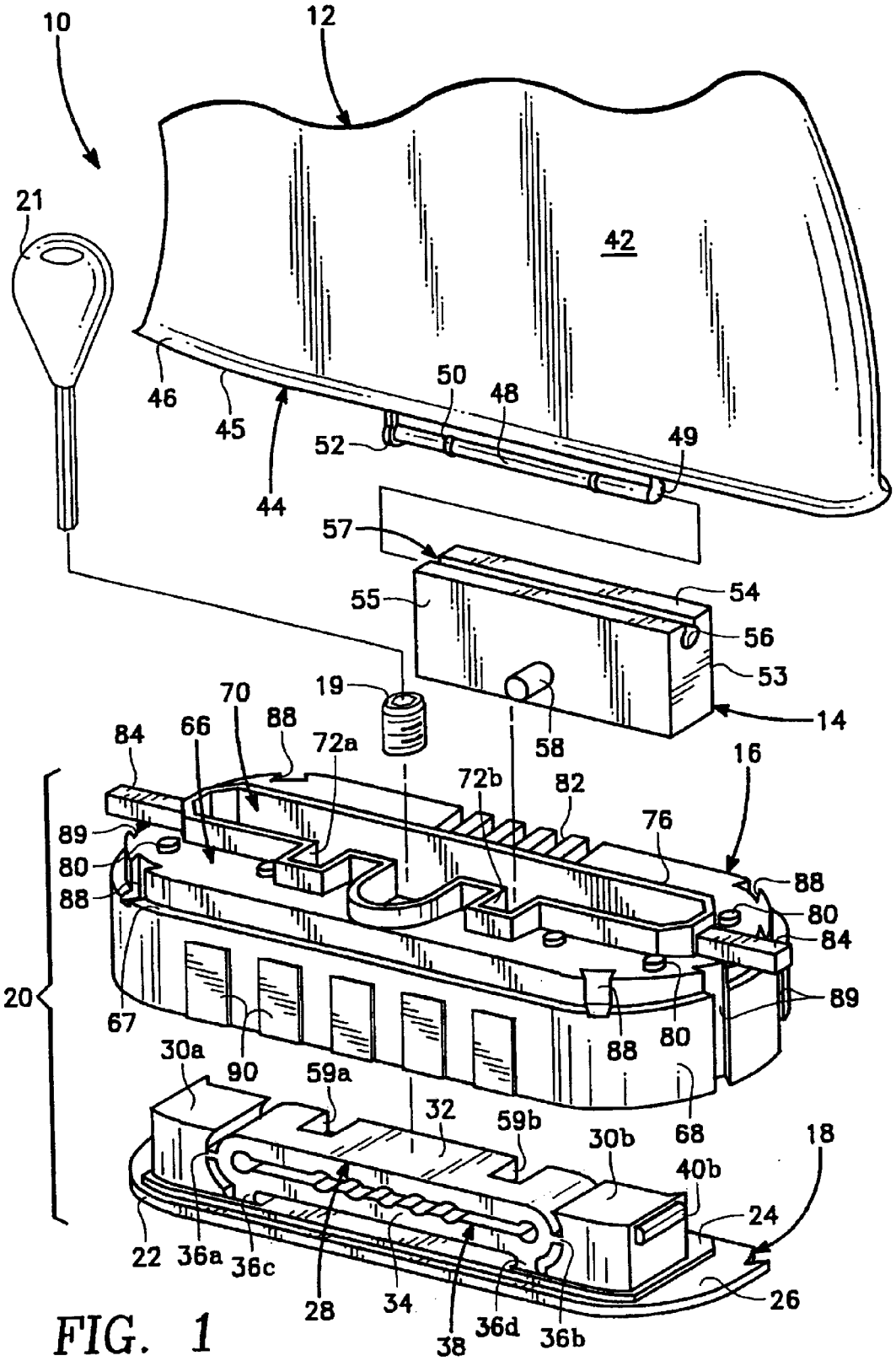
FIG. 1 is an exploded left side isometric view of the fin attachment system of the present invention.

Referring now to the Figures, the fin attachment system of the present invention is shown and is generally designated by reference character 10. As mentioned above, although the invention is described herein by reference to a surfboard, it is intended that the term "surfboard" comprehends all types of water craft and sportboards used in relation to water.

In brief overview, an embodiment of the system described in FIGS. 1 and 11–23 comprises a fin 12 and a tag 14 that can be selectively attached/detached to the underside of the fin. An alternative embodiment described particularly in FIGS. 15–18 includes a fin-and-tag combination integrally formed in a single unit. Although the initial discussion is directed to the detachable fin 12 and tag 14 embodiment, many of the features and details of FIGS. 1–14 have direct application to the unitary fin/tag embodiment that is specifically addressed in FIGS. 15–18.

According to the detachable fin 12 and tag 14 embodiment, the system includes a socket 16 and a plug 18 that cooperate to define tag engagement member 20. The tag engagement member 20 is embedded into the surfboard 104 and receives the tag so that the tag and the fin (when attached to the tag) may be secured to the surfboard (See FIG. 14). A cap screw 19 and an implement shown as hex key 21 for turning the cap screw, are used to exert a force on the plug to engage the tag in a manner more fully described below.

Referring now primarily to FIG. 1, the fin comprises a dorsal section 42 that merges into fin base 44 having a generally flat underside surface 45. A fillet 46 extends around the base periphery in a somewhat bell-shaped configuration. The fillet reinforces the fin against forces normal to the dorsal section during operation of the surfboard. A flange 52 extends downwardly from the mid-portion of fin underside 45. A longitudinal rail 48 is fixed at a proximal end to the flange 52 and extends to an opposing free end 49. The rail is offset from the fin underside a distance sufficient to create a mating engagement between underside 45 and tag top surface 54. Although one flange is shown and described herein, two or more flanges or one elongated flange extending along a portion of the rail could be used to strengthen the fin-to-rail connection.

The rail is aligned with the long axis of the fin and has a length that is preferably about less than one-half the length of the fin. The rail has a circular cross-sectional so that it may rotatably and slidably engage guide channel 56 of the tag 14. The rail may include a plurality of outwardly extending spaced-apart ribs to enhance frictional engagement with the tag guide channel 56.

The aforementioned detachable tag 14 comprises a solid block-like structure having a front side wall 55 and a back side wall 53. It includes opposing end walls that define a length that is preferably at least half the length of rail 48. The 14 tag has a top surface 54 which is preferably flat to provide a mating engagement with a corresponding flat portion of fin underside 45.

Extending downwardly into the top surface 54 is the guide channel 56. The guide channel has a cross-section that is about equal to the rail cross-section so that snug translational movement can occur between the parts. The channel should be located below top surface 54 a predetermined distance that corresponds with the space between rail 48 and fin underside 45. In this way, a close mating engagement can occur between the aforementioned corresponding portions of the fin underside surface 45 and tag top surface 54.

In contrast to the separable tag 14 and fin 42 of FIG. 1, an alternative embodiment discussed in greater detail in conjunction with FIGS. 15–23 describes a fin 101 and tag 103 integrally constructed from a single contiguous solid member.

Another distinction between the embodiment of FIGS. 1–14 and the embodiment depicted in FIGS. 15–23, is that tag 14 of FIG. 1 is held in place by a tag-pin 58 extending laterally in only one direction from the tag 14 and secured to within a single clamp 28 by a single grub screw 19 threadably engaged with the socket 16 and/or plug 18. The single clamp 28 is supported by compression trusses 36*c,d*.

Figure 15:
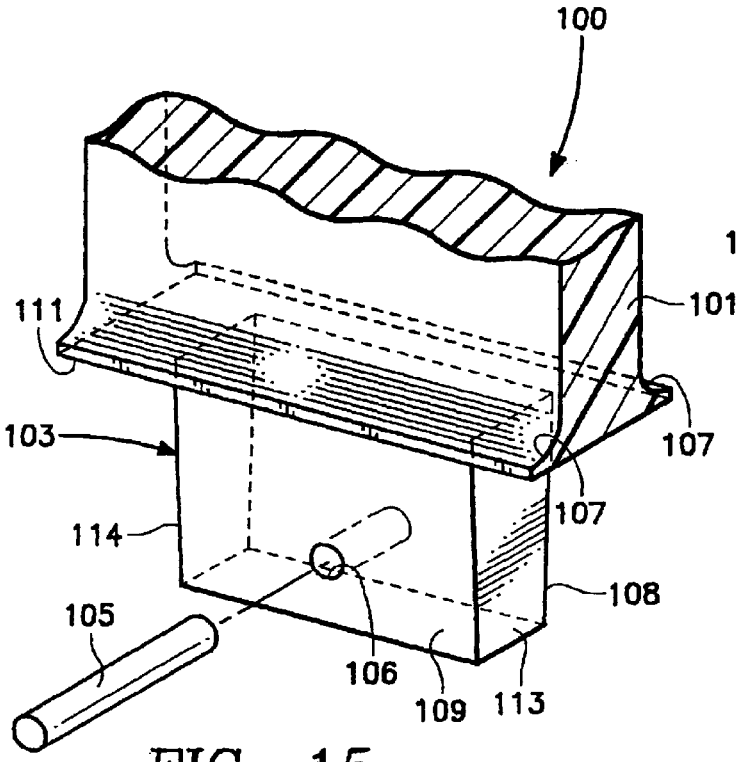
FIG. 15 is an exploded front isometric view of a unitary fin-and-tag combination with a bilateral tag-pin according to an alternative embodiment of the present invention.
Figure 19:
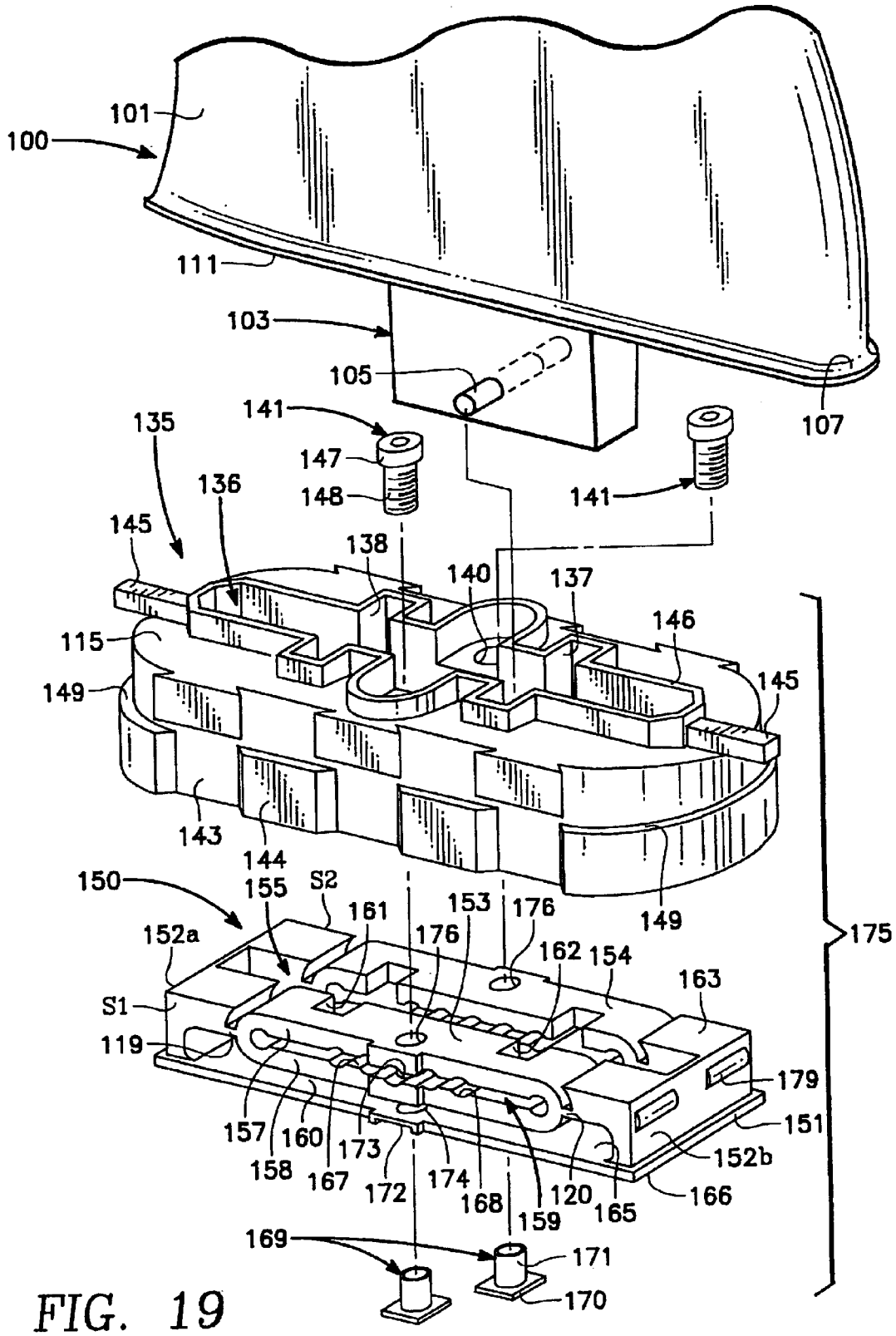
FIG. 19 is an exploded isometric view of an alternative tag engagement unit.

In contrast, the bilateral tag 103 of FIG. 15 is a bilateral tag-pin 105 protruding laterally from both sides of the tag 103 about perpendicular to the vertical plane 112 defined by the fin. Opposing ends of the bilateral tag-pin are respectively engaged by adjacent floating clamps designated front clamp 153 and rear clamp 154, as shown in FIG. 19. The floating front and rear clamps 153, 154 are each suspended at opposing ends by flexible anti-torsion suspension members 119, 120. The front and rear clamps 153, 154 are respectively secured by tightening means shown as first and second cap screws 141 that threadably engage a metal T-nuts 169.

Notwithstanding many of the distinctions between the referenced embodiments, many structural, material, fabrication and assembly aspects are similar, and those skilled in the art will recognize that many statements directed herein to only one of the two embodiments can be readily applied to the other embodiment.

Referring again to FIG. 1, the front side wall 55 of the tag has a tag pin 56 extending outwardly from the side wall lower central portion. The tag pin has a length and diameter sufficient to engage pin slot 38 in a manner to be described below.

For assembly of the tag to the fin, free end 49 of rail 48 is inserted into rear open end 57 of guide channel 56. The tag is slid along the rail until it abuts a stop means shown as flange 52. Other abutment structures could also be used such as cross-pins, pegs, ribs, rings and projections. The annular ribs 50 shown on the guide rail, enhance friction engagement between the channel and rail to thereby firmly engage the tag to the fin.

Figure 11:
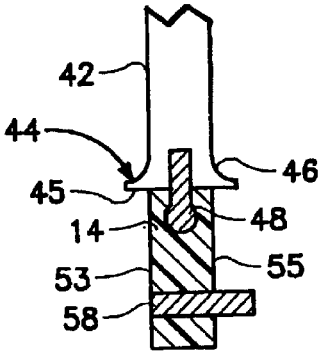
FIG. 11 is a cross-sectional schematic end view showing the perpendicular attachment of the fin to the tag.

As mentioned previously, the tag top surface 54 may be flat for a mating coplanar engagement with a similar flat surface 45 on the fin underside. Similarly, if either or both of the surfaces are beveled, the fin will assume a tilt relative to the plane of the board underside. In FIG. 11, the plane of the fin underside is perpendicular to the fin vertical axis and the plane of the tag top surface is parallel with the board underside plane. This results in the fin being aligned perpendicular to the board underside plane.

Figure 12:
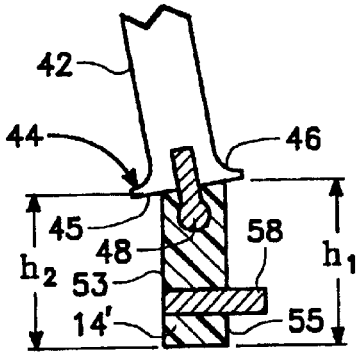
FIG. 12 is a view similar to FIG. 11 showing the tag upper surface beveled and the fin tilted at an angle complimentary to the angle of bevel.
Figure 14:
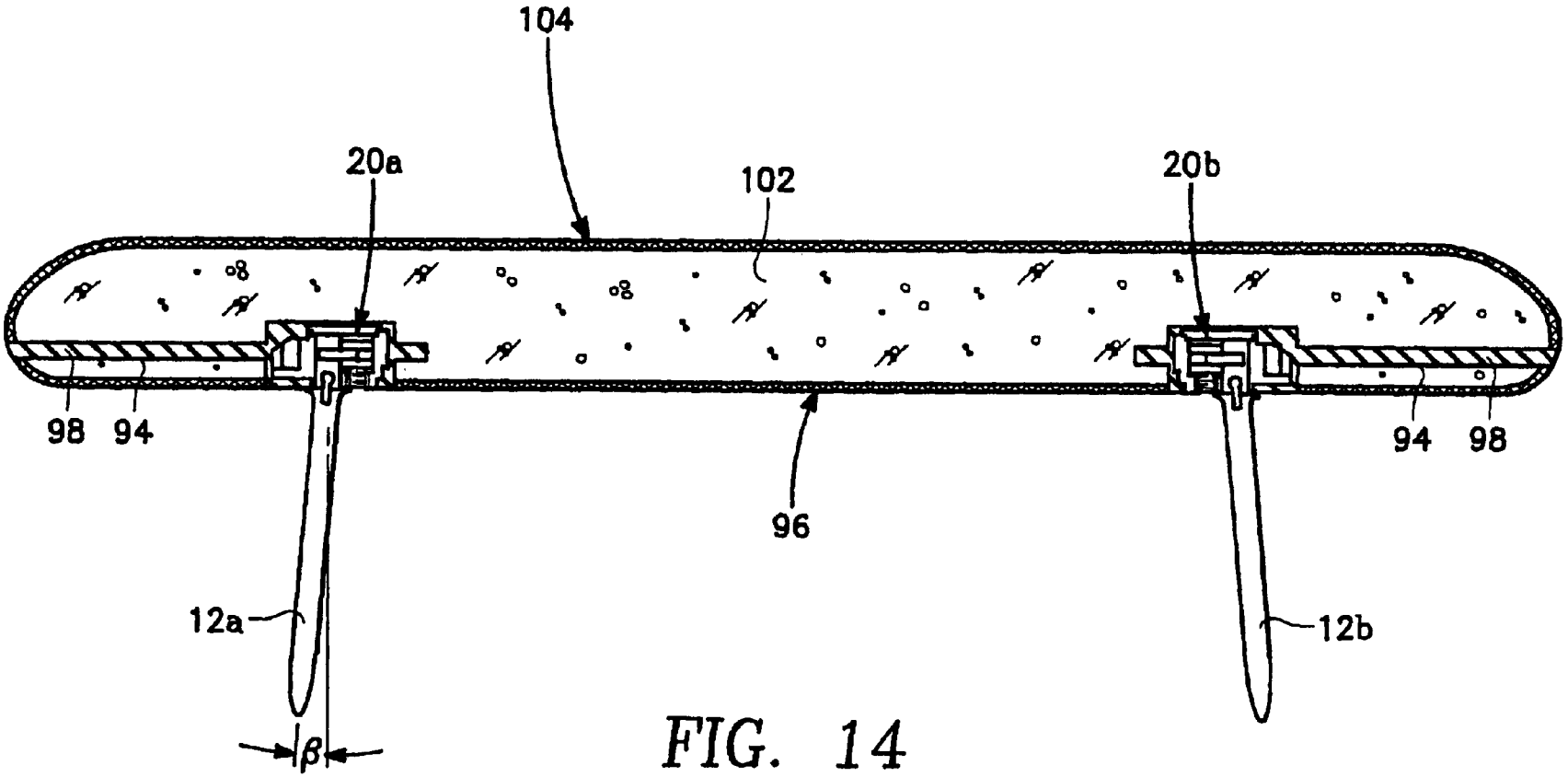
FIG. 14 is a cross-sectional view across the rear portion of a surfboard showing a pair of fins installed with the tag, socket and tag engagement member of the present invention.

Alternatively, as shown in FIG. 12, the top surface of tag 14' can be beveled across its width so that the tag has a resultant continuing decrease in height from a maximum height $h_1$ on first side 55 having the tag pin, to a minimum height $h_2$ on the opposing tag back side wall 53. When the beveled tag is fastened to the fin, and the tag is then inserted into the surfboard as described below, the net effect is a fin that extends from the underside at an angle $\beta$ as shown in FIG. 14. It will be appreciated that to achieve the angular position, rail 48 will rotate counterclockwise within channel 56.

Figure 13:
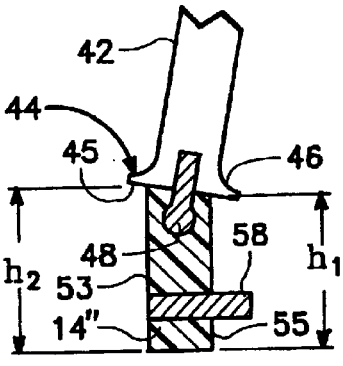
FIG. 13 is a view similar to FIG. 12 with a different tag bevel angle and fin angle.

Conversely, the tag upper surface can be inclined so that the tag has a resultant continuing increase in height from a minimum height $h_1$ on front side wall 55 to a maximum height $h_2$ on the opposing back sidewall 53 (see tag 14" in FIG. 13). This configuration yields the angled fin 12*b* shown in FIG. 14.

Accordingly, the detachable tag subassembly affords great flexibility in the selection of angular fin placement. Stated differently, the detachable tag subassembly allows the user to choose a fin roll angle to maximize surfboard performance according to the desires of the user. It should also be appreciated that the angles from vertical that are established by the fin-tag combinations shown in FIGS. 11–13, are not intended to be limiting and a much wider range of angles B is envisioned by the present invention.

The tag engagement member 20 comprises the combination of a plug structure 18 and a peripheral socket 16. The plug includes a plate-like base 22 having a defined base outline. Resting upon the base is an upraised base portion 24 having an inset periphery that is spaced inwardly from the base outline. The area between the inset periphery and base outline defines a shoulder 26.

A clamp 28 extends upwardly from the upraised base portion. As shown, the clamp is an elongated solid structure that has been configured to provide an adjustable clamp means for tag 14. It comprises opposing end portions 30*a*, 30*b*, having ridge parts 40*a*, 40*b* extending outwardly from respective outer faces of each end portion. The ridges frictionally engage the interior socket cavity 41 of socket 16 (shown in FIG. 3) when the plug is inserted into the cavity as described below.

Clamp 28 further includes an upper clamp portion 32 and a lower clamp portion 34 that are located between the end portions 30*a*, 30*b* and connected to the end portions with respective trusses 36*a*, 36*b*. The upper clamp portion 32 and lower clamp portion 34 define a pin slot 38 for receiving the aforementioned tag pin 58. The interior surfaces of the pin slot are provided with friction engagement means shown as a plurality of corresponding spaced-apart upper notches 60 and lower notches 62. The notches comprise arcuate indentations sized to engage outer surface portions of tag pin 58.

Spaced-apart pin channels 59*a*, 59*b* are formed in the upper clamp portion proximate the opposing ends of the pin slot 38. The pin channels intersect the pin slot to allow for passage of the tag pin through the upper clamp portion into the pin slot. Once in the slot, the pin can be moved laterally and become engaged with a corresponding upper notch and lower notch.

Trusses 36*c*, 36*d* support respective opposing ends of the lower clamp portion 34 in a spaced-apart relationship with the upraised base portion 24. The open space created thereby defines a compensation slot 64 between the lower clamp portion and the upraised base portion 24. The compensation slot accounts for any oversanding during installation of the tag engagement member to the sportboard by allowing the lower clamp portion (in addition to the upper clamp portion) to flex as described below. This will insure that the lower clamp portion and upper clamp portion will always be able to securely grip tag pin 58 during operation of the assembly.

Socket 16 is an oblong peripheral structure having an open bottom from which extends a socket cavity 41. The cavity is defined by a surrounding side wall 68 and the cavity interior is sized to receive the plug structure 18.

Overlying the cavity is top wall 66. Access through the top wall to the cavity is provided by tag slot 70. The tag slot is elongated and configured to permit passage of tag 14 and includes spaced-apart cut-out areas 72*a*, 72*b*. Each cut-out area is aligned with a respective pin channel 59*a*, 59*b* so that tag pin 58 will pass freely into pin slot 38 of the plug.

A threaded cap screw opening 74 is formed in the top wall 66 adjacent tag slot 70 and between the cut-out areas 72*a*, 72*b*, at approximately the mid-portion of the socket. A temporary resin barrier wall 76 extends upwardly from the top wall and follows periphery of the tag slot, the cut-out areas and the cap screw opening. The resin barrier prevents entry of resin into the cavity during installation of the assembly.

Figure 6:
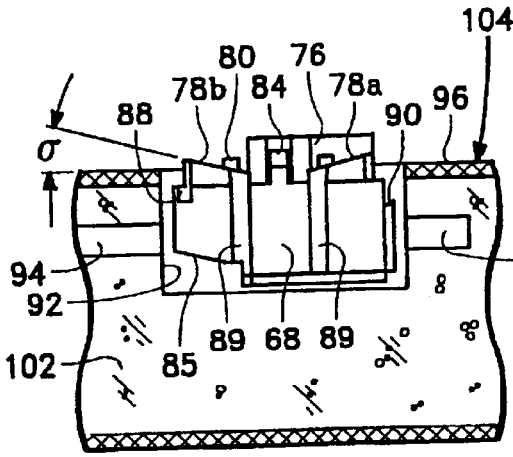
FIG. 6 is a fragmentary cross-sectional view taken along lines 6—6 of FIG. 4.
Figure 7:
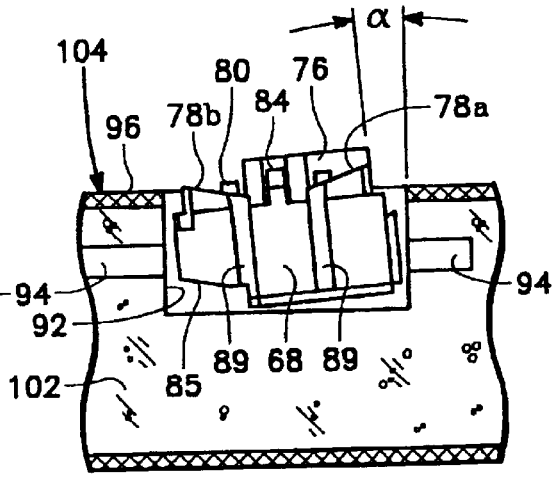
FIG. 7 is a view similar to FIG. 6 with the tag engagement member canted to illustrate an alternate installation embodiment of the tag engagement member within the surfboard.
Figure 8:
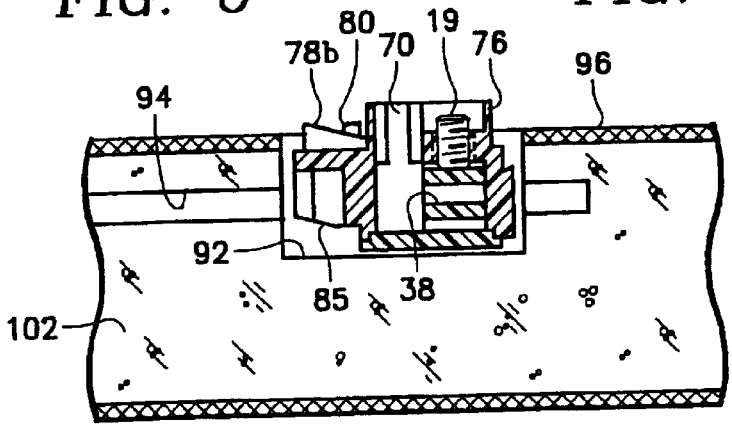
FIG. 8 is a fragmentary cross-sectional view taken along lines 8—8 of FIG. 4.

The top wall includes a multiplicity of features which facilitate installation of the assembly within a sportboard and operation of the system after installation. Specifically, and referring now primarily to FIGS. 6–8, top wall 66 may be formed with opposing bilateral beveled surfaces 78*a*, 78*b*. The beveled surfaces incline upward from the centerline of the socket to side wall 68 so that they form an angle σ with a horizontal plane when the tag engagement member (and socket) are oriented horizontally, as can be seen in FIG. 6. The inclined surfaces 78*a*, 78*b* allow the socket to be canted during installation (See FIG. 7), yet still have one inclined surface that is co-planar with the surfboard underside 96 after assembly. This provides the user with additional installation options if a more extreme fin roll angle is desired.

To further facilitate installation, a plurality of spaced-apart indicator pegs 80 extend upwardly from the beveled surfaces. The pegs provide an installer with a visual indication of when an appropriate amount of excess resin has been removed during installation of the device to a surfboard. Temporary outriggers shown as shafts 84, 84, are fixed to each opposing end of top wall 66 of the socket. The outriggers are aligned with the longitudinal centerline of the socket and extend longitudinally outward past side wall 68.

Figure 2:
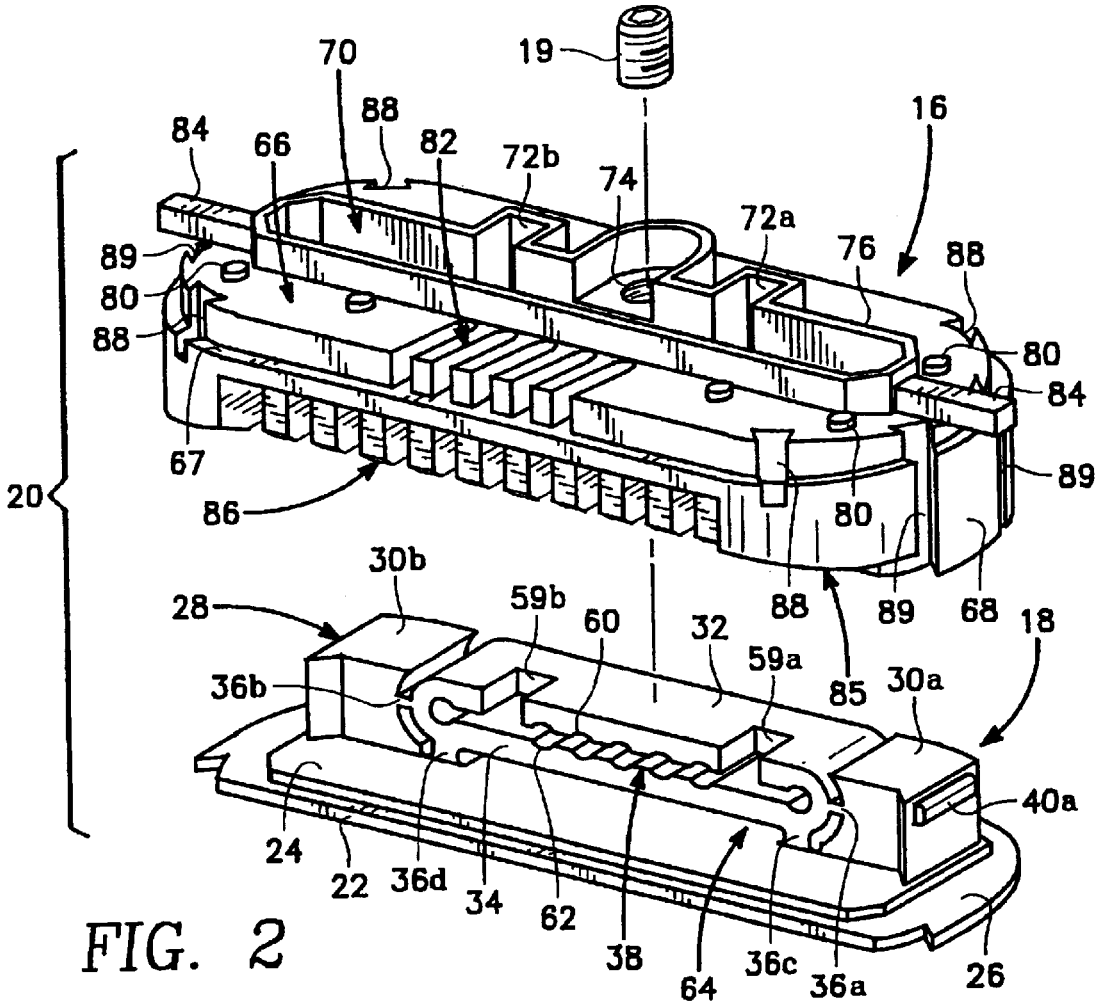
FIG. 2 is an exploded right side isometric view of the tag engagement member of FIG. 1.
Figure 3:
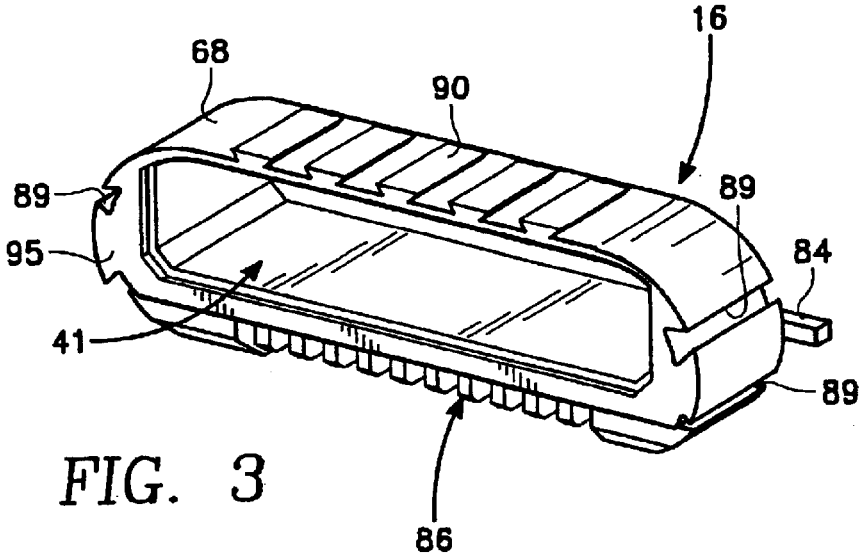
FIG. 3 is an isometric view of the underside interior of the socket of the tag engagement member shown in FIG. 1.
Figure 4:
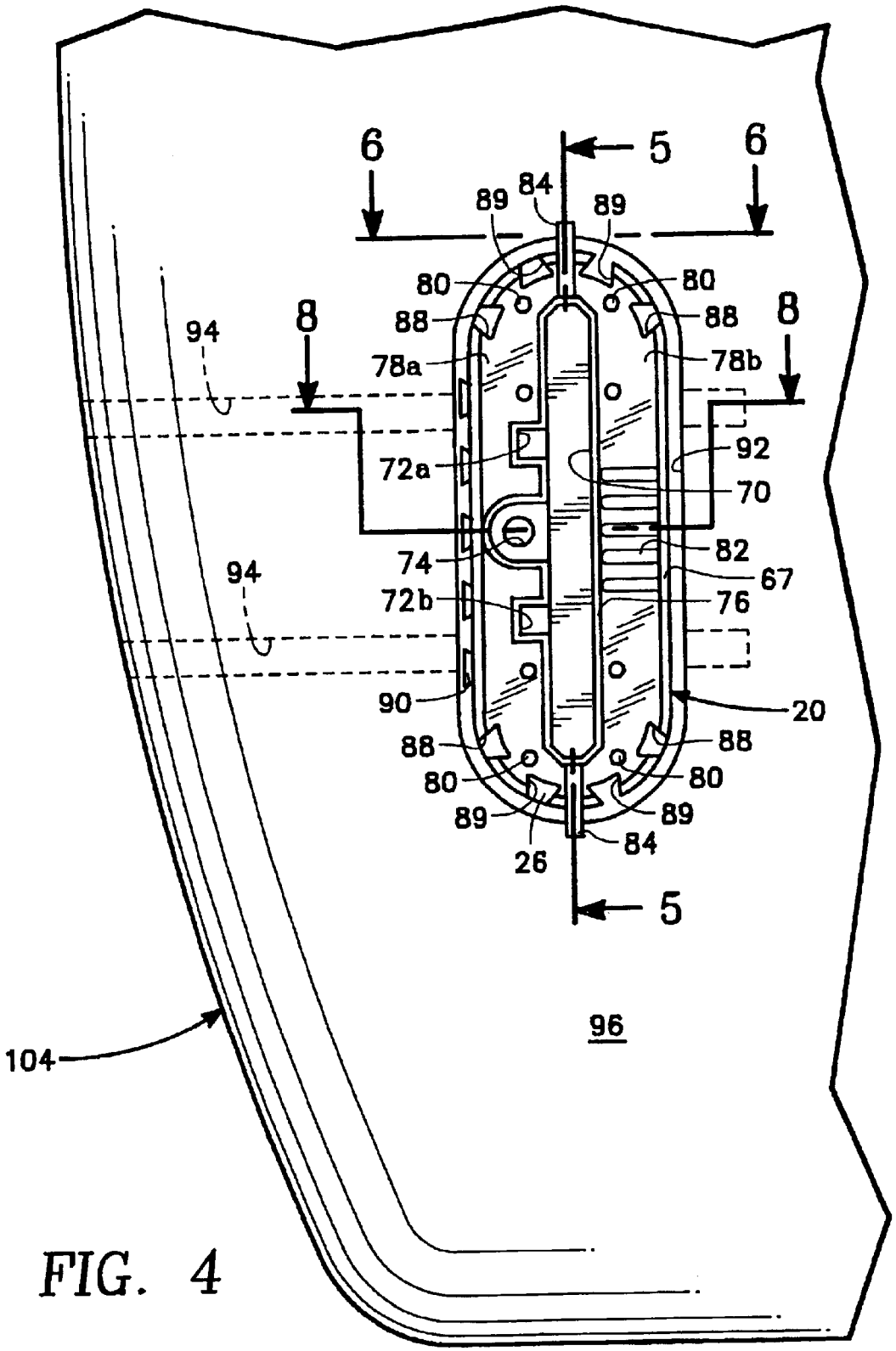
FIG. 4 is a top plan view of the tag engagement member shown in FIG. 1, fitted within a surfboard recess with surfboard transverse bores shown in phantom.
Figure 5:
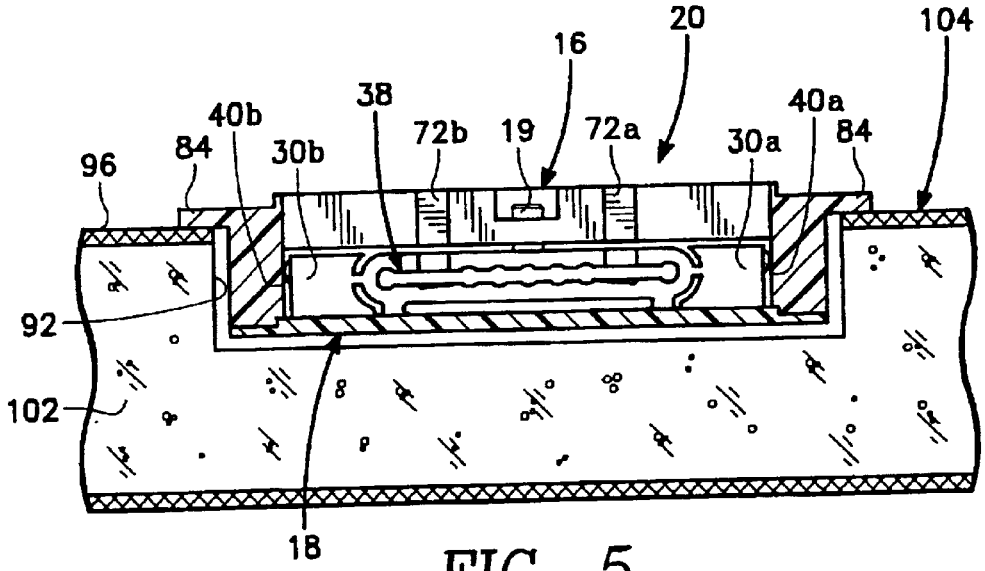
FIG. 5 is a fragmentary cross-sectional view taken along lines 5—5 of FIG. 4.

As shown in FIGS. 2 and 3, a plurality of adhesion grooves 86 are formed in the lower recessed portion of side wall 68. The adhesion grooves provide an increased overall surface area for bonding the socket to recess 92 with resin during installation of the tag engagement member. Similarly, a plurality of spaced-apart short and long socket notches 88 and 89 extend vertically at locations proximate end portions of the side wall. The socket notches provide increased surface areas for resin adhesion during assembly.

As best seen in FIGS. 1 and 2, the top wall 66 also includes a plurality of horizontal spaced-apart location fingers 82 that are located opposite the tag slot 70 from cap screw opening 74. The fingers have a color that contrasts with the surrounding resin. They are positioned above a respective upper notch and lower notch in the socket clamp 28 and allow the user to determine the location of pin 58 within the pin slot 38. When fin 12 is attached to the installed tag engagement member, the fingers will also provide the user with an indication of the location of the tag (and fin) relative to the tag engagement member. As such, the fingers 82 provide a visual indicator for a series of fin positions which are selectable by a user.

The side wall 68 of the socket also includes one or more undercut anchor ribs 90. The anchor ribs extend vertically from socket base 95 to an upper portion of top wall offset lip region 67. The ribs provide a visual indicator of resin level in recess 92. They also function to help secure the tag engagement member 20 to surfboard core 102.

FIGS. 15–18 are directed to an alternative embodiment of the present invention utilizing a unitary fin and tag member shown generally by reference 100 in conjunction with a bilateral tag pin 105.

The fin 101 and the tag 103 are formed from a single unitary member and are not detachable from one another. The fin 101 and tag 103 may be formed from a machined part or aa single homogeneous member, which may include reinforcing fibers or fibrous mats incorporated into the fin-and-tag member 100.

As best shown in FIGS. 15–18, a tag-pin hole 106 extends laterally through the tag. A bilateral tag pin 105 is inserted through the tag-pin hole 106 and protrudes beyond the exterior surface of both sides 108, 109 of the tag 103, thereby providing bilateral structural securement to the tag when the sport board is used in water or the fin is exposed to lateral forces from either direction. The tag-pin 105 can be fixed within the hole 106 during the molding process or by subsequent bonding or adhesive processes. Alternatively, the pin can slide freely within the hole 106.

Figure 20:
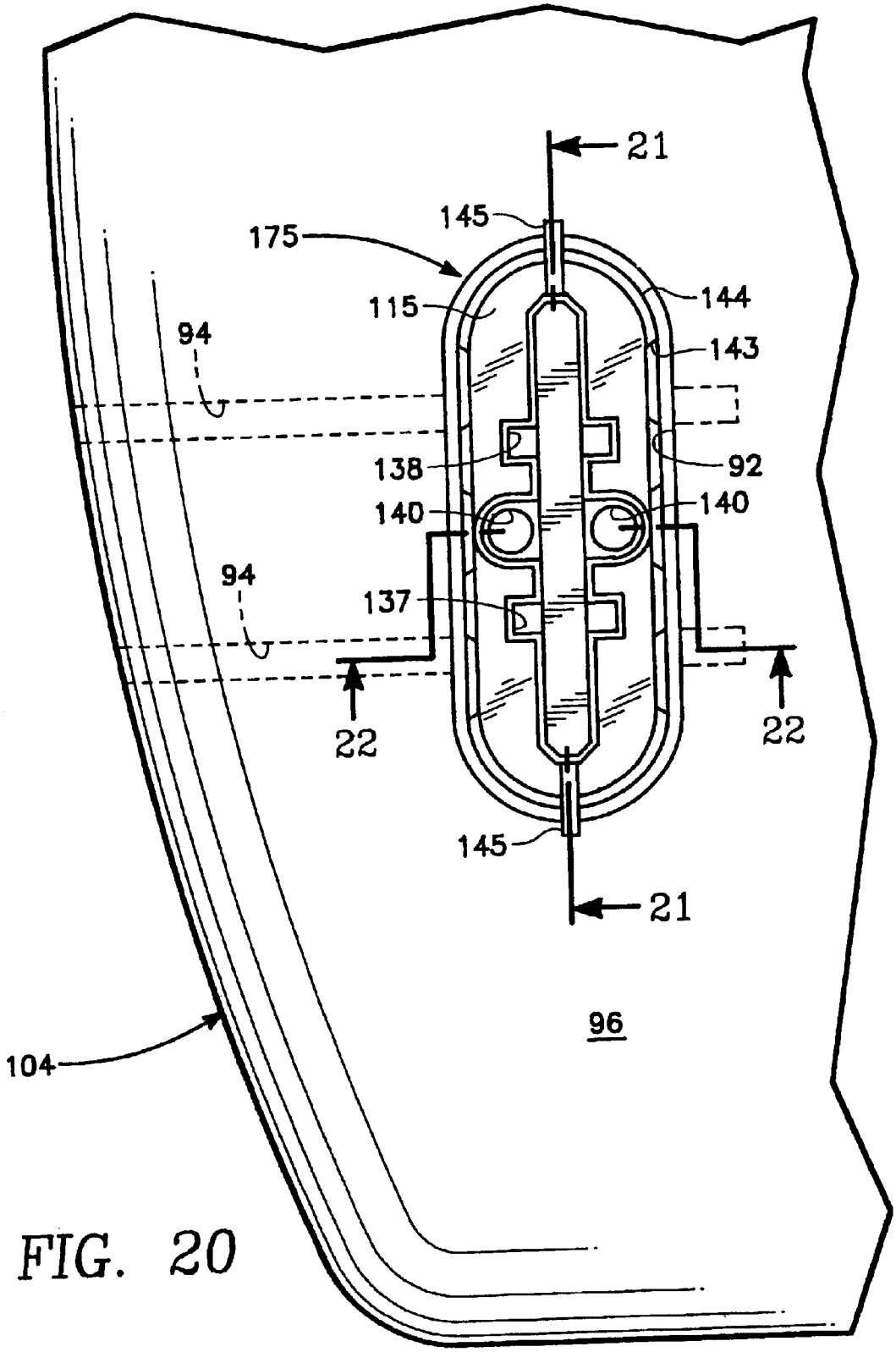
FIG. 20 is a fragmentary bottom plan view of a sport board with the tag engagement shown in FIG. 19, fitted within a sportboard recess with surfboard transverse bores shown in phantom.

The base of fin 101 includes opposing outwardly flared flanges 107 running longitudinally along both sides of the fin, from proximate the forward end of the fin to proximate the rear end of the fin. The fin underside 111, which comprehends the coextensive flanges 107 undersides, conform to the underside surface 96 of the sport board 104 (FIG. 20). It is understood that if a particular geometric pattern, such as a grooved channel were formed in the surface 96 of the sport board 104, the fin underside 111 would include a complementary raised groove to engage with that particular geometric pattern on the sport board surface 96.

Tag 103 is preferably a solid body having polygonal cross-sectional shape. It extends about perpendicularly downward from fin underside 111 a predetermined distance that is sufficient to form an effective engagement with tag engagement unit 172. The bilateral flanges 107 formed on opposing sides of the fin increase the lateral width of the fin area engaging the surface of the sport board, thereby increasing the moment arm by which the sport board exerts a resistive moment against the fin as lateral forces impinge on the fin.

The first and second side surfaces 108, 109 of the tag 103 can have an inward taper. An exemplary tag of FIG. 18 has an inward taper of about two degrees on each side of the center line 112, for a total taper of about four degrees. The total taper of the tag 103 is preferably within a range of one degree and ten degrees, though greater and lesser tapers are envisioned within the scope of the present invention. Because the tag 103 is secured within the plug slot 155 discussed below, mutually facing surfaces of the plug slot 155 are tapered at an angle matching the taper of the tag 103, thereby providing maximum securement of the tag 103 within the plug slot 155.

Figure 21:
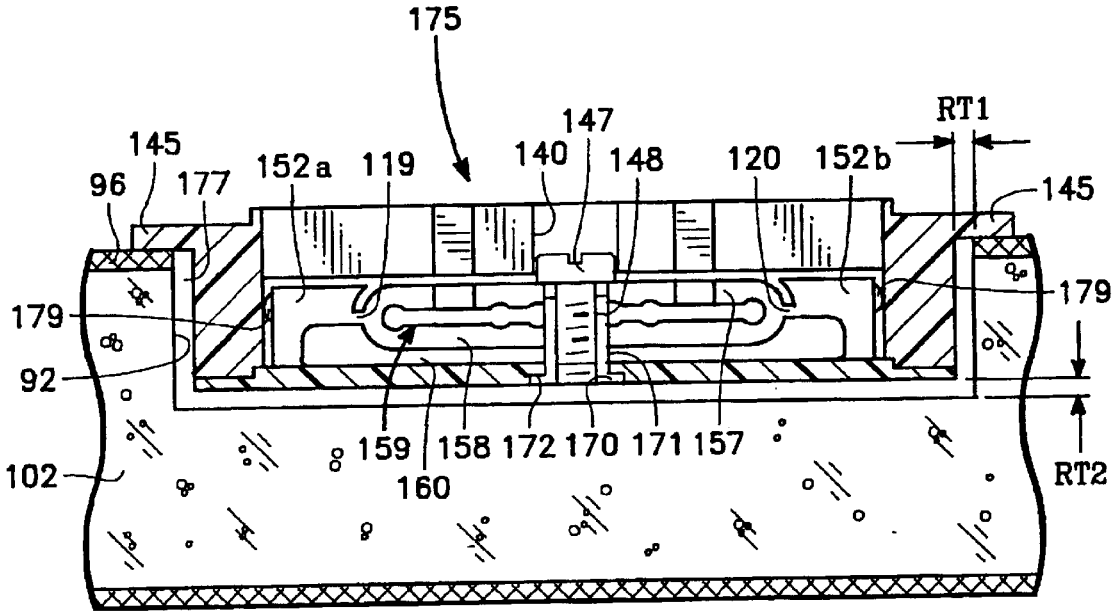
FIG. 21 is a fragmentary cross-sectional view taken along lines 21—21 of FIG. 20.
Figure 22:
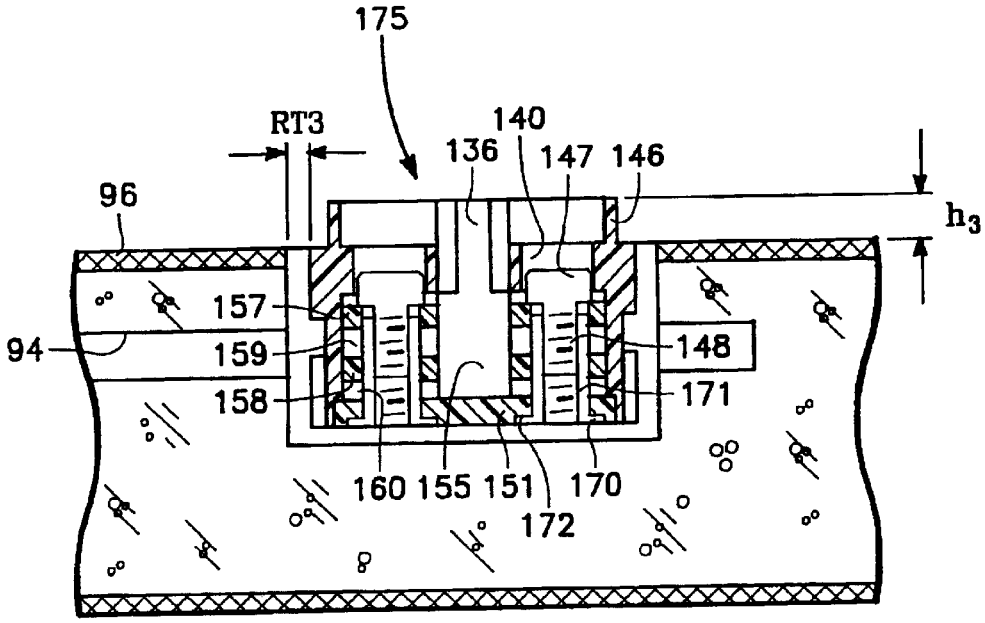
FIG. 22 is a fragmentary cross-sectional view of a sport board and tag engagement taken along lines 22—22 of FIG. 20.
Figure 23:
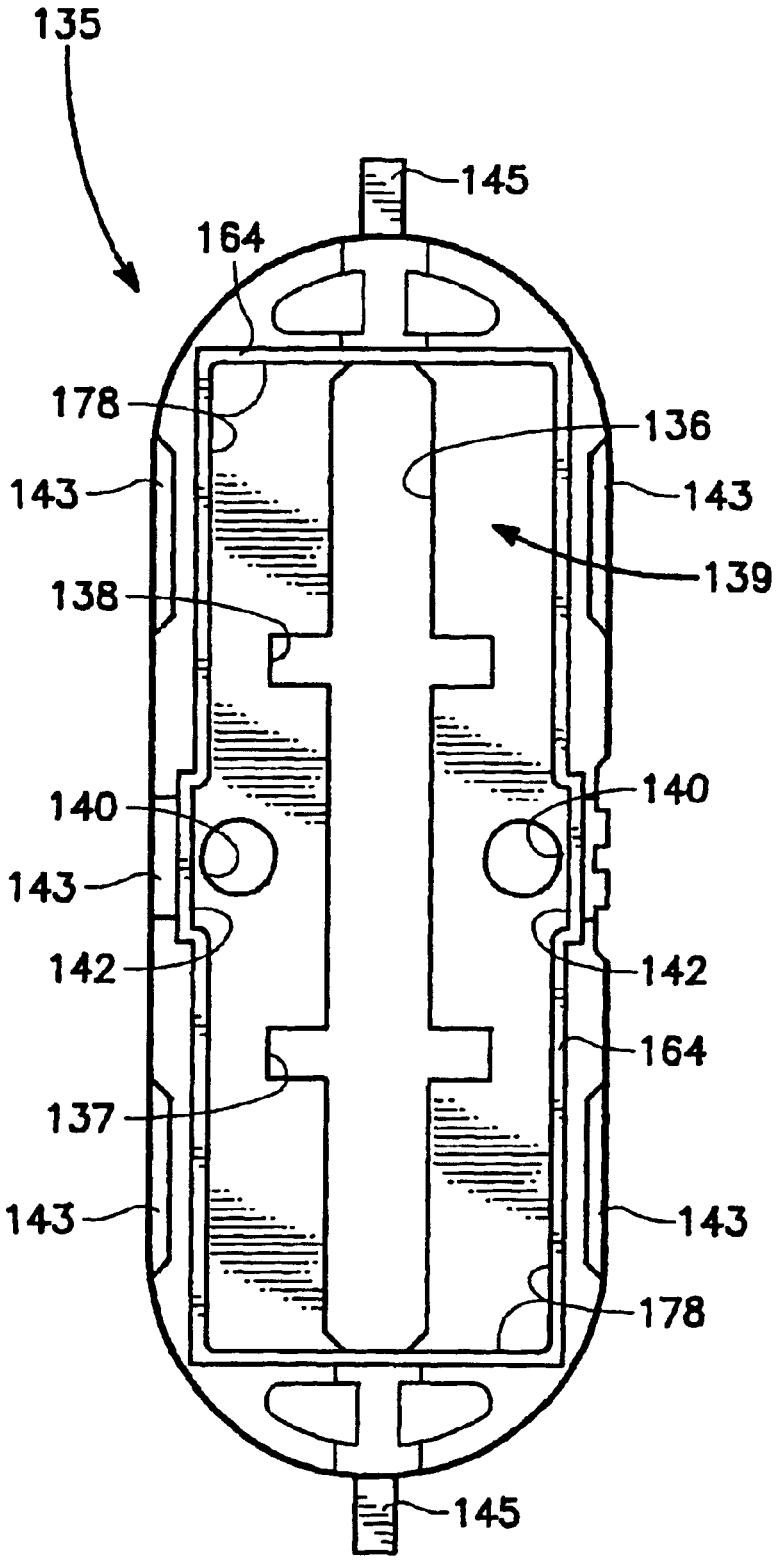
FIG. 23 is a bottom plan view of the bilateral socket of FIG. 19.

FIGS. 19–23 show a bilateral socket 135 similar to the socket 16 discussed above, but configured to receive and engage a bilateral tag pin 105. Referring primarily to FIGS. 19 and 23, the bilateral socket is a solid member having vertical sides 144 and a planar socket cover 115. The socket has an inner cavity 139 (FIG. 23) configured to receive the bilateral plug 150. The vertical sides 144 are divided by resin channels 143 which, during fabrication, allow resin to flow around the sides 144 of the socket 135. A horizontal ledge 149 is formed at select areas where resin channels 143 abut the vertical sides 144. The horizontal ledge 149 establishes a structural engagement surface by which the socket 135 is held more securely within the sport board recess 92 as the resin hardens around the socket 135.

Extending through socket cover 115 is a tag slot 136 that provides access to inner cavity 139. The slot extends longitudinally through the center area of the cover, and has an outline that accommodates the tag cross-sectional shape. In this way, the tag can pass through the cover 115 into cavity 139.

As discussed above, a bilateral tag-pin 105 protrudes from both sides 108, 109 of the tag. To allow insertion of a bilateral tag pin 105, cross-slot pin guides 137, 138 are formed in the cover 115, intersecting the tag slot 136 in a substantially perpendicular orientation, and extending an equal distance on both sides of the tag slot 136. The cross-slot pin guides 137, 138 are large enough to allow passage of the bilateral tag-pin 105 as the tag 103 is lowered into the tag slot 136. The two cross-slot pin guides 137, 138 are formed symmetrically in mirror image an equal distance from the longitudinal center of the tag slot 136. The dual location of the cross-slot pin guides and accommodative length of tag slot 136 allows insertion of the tag 105 from two different lateral orientations, wherein the bilateral tag-pin 105 can be inserted forward or aft of the longitudinal center of the tag slot, aligned over either of the two cross-slot pin guides 137, 138.

Two cap screw openings 140 extend through socket cover 115. An opening is located on each adjacent side of the tag slot 136 and between pin guides 137, 138. The cap screw openings 140 are sized to allow heads 147 of the cap screws 141 to pass through the openings.

A single contiguous resin wall 146 is formed around the periphery of the tag slot 136, cross-slot pin guides 137, 138 and cap screw openings 140 to prevent resin from entering these areas during fabrication. As discussed below, during fabrication, the bilateral socket is placed into a recess 92 within a sportboard as illustrated in FIGS. 20–22. Outriggers 145 on the ends of the bilateral socket 135 extend beyond the edges of the recess 92 and engage the underside 96 of sportboard 104, as the bilateral socket 135 is lowered in place, thereby defining the depth to which the bilateral socket 135 can be lowered into the recess 92. Resin channels 143 (FIG. 16) formed in the sides of the socket 135 allow resin to flow around the sides of the socket during fabrication, and to more securely engage the outer surface of the bilateral socket. After fabrication, the resin wall 146 and outriggers 145 are sanded flush with the surface 96 of the sport board 104 and socket 135.

Referring primarily to FIGS. 19 and 23, a cavity sub-wall 164 defines an interior cavity 139 of the bilateral socket 135. The cavity sub-wall 164 is distinguished from the socket wall 143, which forms the exterior surface of the socket. A bilateral plug 150 (FIG. 19) fits within the inner cavity 139 (FIG. 23) of the bilateral socket 135 to form a unitary bilateral tag engagement member 175. The plug has a plug base 151, which, according to alternative embodiments, may nor may not be sized to frictionally engage the interior surface 178 of the cavity sub-wall. Although the preferred embodiment envisions a bilateral plug 150 tooled or molded from a single piece, alternative embodiments are envisioned wherein the bilateral plug 150 can be formed from a collection of separate pieces secured into a unit to form a bilateral plug.

The base 151 has a base upper surface 165 and a base bottom surface 166. First and second structural end portions 152*a,b* are disposed at opposite ends of the base, extending upward from the upper base surface 165, and extend laterally from a front surface S1 to a rear surface S2. Pressure ridges 179 (FIGS. 19 and 21) formed on the outer end surfaces of the first and second end portions 152*a,b* frictionally engage the inner surfaces 178 of the cavity 139 (FIG. 23) as the bilateral plug 150 is inserted into the cavity during fabrication. Embodiments are also envisioned wherein grooves are formed on the inner surfaces of structural wall 164 for engaging the pressure ridges in a snap fitting.

Parallel front clamp 153 and rear clamp, 154 are suspended above plug base 151 and disposed in a longitudinal orientation on a common planar elevation between the structural end portions 152*a,b*. Because some of the elements of the rear clamp 154 are partly obscured in FIG. 19, the following discussion is largely directed to the front clamp 153. However, because the front clamp 153 and rear clamp 154 are symmetrically disposed on opposite sides of a longitudinal center plane in mirror image of each other, features describing the front clamp 153 also apply to the rear clamp 154.

The first end of front clamp 153 is secured to the first structural end portion 152*a* by flexible anti-torsion suspension member 119. The second end of front clamp 153 is secured to the second structural end portion 152*b* by flexible anti-torsion suspension member 120. A flex space 160 separates the front clamp from the base 151 such that the front clamp 153 is suspended above the base 151 by the first and second flexible anti-torsion suspension members 119, 120. To allow the front clamp 153 to flex downward toward the base 151, the suspension members 119, 120 are advantageously made from a strong, flexible material, such as ten-percent glass filled acetyl. However, a variety of plastics, including fiber-glass filled resins, nylon, ABS and other plastics, can be advantageously used. As noted, the preferred embodiment envisions forming the entire bilateral plug 150 as an integrated unitary member.

The front clamp 153 comprises a continuous loop with in inner pin slot 159. It is formed from an upper clamp member 157 with an elongated body portion and a lower clamp member 158 with an elongated body portion. The first ends of the upper and lower clamps come together at a curved junction and merge into flexible anti-torsion suspension member 119. The second ends of the upper and lower clamps come together at a curved junction and merge into flexible anti-torsion suspension member 120. The suspension members extend inwardly from respective first and second end parts 152*a,b* a predetermined distance above plug base 151 that is sufficient to create the aforementioned flex space 160. As such, the upper and lower clamp members 157, 158 are separated vertically by the aforementioned elongated pin slot 159. The pin slot 159 is wide enough to allow a tag-pin 105 to move laterally within the slot 159.

Opposing surfaces of the upper clamp member 157 and lower clamp member 158 have a plurality of transversely extending opposing ridges 167 and grooves 168 forming corresponding rows of clamping teeth along the pin slot 159. The teeth are sized to secure the end of a tag pin 105 in a slotted groove 168 when the clamp members are drawn together.

Figure 17:
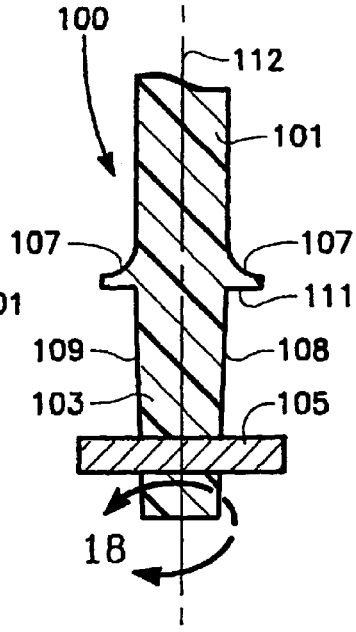
FIG. 17. is a cross sectional view taken along lines 17—17 of FIG. 16.
Figure 16:
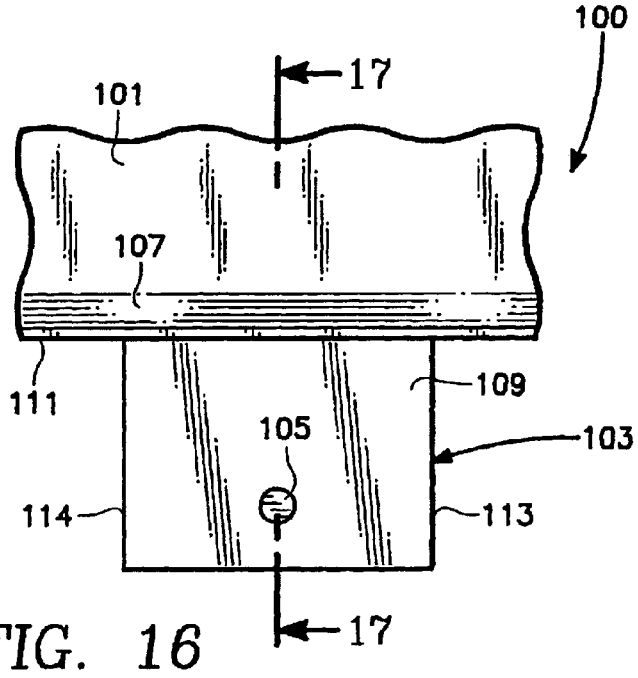
FIG. 16 is a side view of a unitary fin-and-tag combination show in FIG. 15.
Figure 18:
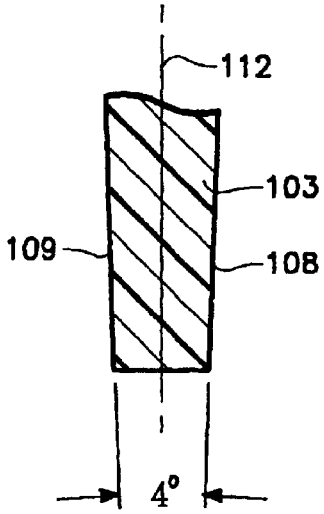
FIG. 18 is an enlarged cross-sectional view taken along line 18 of FIG. 17.

As discussed above, a rear clamp 154 is partly obscured in FIG. 19. The rear clamp is identically comprised of upper and lower clamps suspended by flexible anti-torsion suspension members, and comprised of upper and lower clamps separated by a pin slot. The front and rear clamps 153, 154 are disposed on a common horizontal plane on opposing sides of an imaginary center plane 112 dividing the tag 103 (FIG. 17). The longitudinal axis of the elongated members of both front and rear clamps roughly parallels the longitudinal axis of the sport board. The front and rear clamps are disposed in mirror image to each other across the vertical center plane running through the longitudinal axis of the sport board 104.

A second tag slot 155 is formed in the plug 150 and is configured to align with the first tag slot 136 formed in the bilateral socket 135. The second tag slot 155 is oriented longitudinally along the imaginary center plane 112 and separates the front and rear clamps 153, 154. The second tag slot 155 is wide enough to allow insertion of a tag 103 between the front and rear clamps 153, 154. Opposing interior surfaces of the front and rear clamps are oriented at an angle identical to the taper of the tag 103 discussed in conjunction with FIG. 18.

A first pin-insertion-slot 161 extends through the upper clamp portion 157 proximate the left end, as viewed in FIG. 19. The pin insertion slot provides access to pin slot 159 and allows passage of tag pin 105 into the pin slot during assembly. A second pin-insertion slot 162 is formed in the upper clamp portion 157 proximate the right end of the upper clamp portion. Consistent with the symmetry noted above, identical pin slots are formed in the rear clamp 153 to allow passage of the opposite end of the bilateral tag-pin 105. When the bilateral plug 150 is secured within bilateral socket, the first and second pin-insertion slots 162, 163 are aligned below the first and second cross-slot pin guides of the bilateral socket 135, allowing insertion of a tag 103 and bilateral tag-pin 105.

Two T-nuts 169 each have a base 170 secured to a threaded barrel 171. Each T-nuts 169 functions to threadably engage the threaded shaft 148 of a respective cap screw 141. A polygonal shaped sink 172 is formed in the base bottom surface 166 of base 151 to prevent the base 170 of a T-nut from rotating (FIG. 22). Directly above the counter sink 172, a barrel guide 174 in the form of a cylindrical hole extends upward through the base 151. The diameter of the barrel guide 174 is large enough to allow the T-nut barrel to freely pass through the barrel guide. According to the embodiment of FIG. 19, the front and rear countersinks 172 protrude laterally outward from the base a slight distance. To accommodate this protrusion, the structural wall 164 (FIG. 23) defining the shape of the cavity 139 of the bilateral socket 135 includes salients 142 extending bilaterally outward from the inner cavity on opposing sides of the tag slot 136. The salients 142 are sized to accommodate the protrusion of the countersinks when the tag base 151 is inserted into the cavity 139 of the socket.

On a common axis with the barrel guide 174, cylindrical holes 173, 176 are formed respectively through the lower clamp portion 157 and the upper clamp portion 158. The cylindrical hole 176 in the upper clamp portion is large enough to allow passage of the shaft 148 of a cap screw 141, but not large enough to allow passage of the cap screw head 147 which engages the upper surface of the upper clamp portion 157. As discussed below, as the cap screws are threadably engaged with the T-nuts, the cap screw heads 147 will press against the top surfaces of the upper clamp portions 157 of the front and rear clamps 153, 154, thereby moving together the upper and lower clamp portions 157, 158 around the pin-tag, and securing the ends of the bilateral tag-pin 105 within respective grooves 168 of the front and rear clamps. The hole 173 in the lower clamp portion and hole 176 in the upper clamp portion are large enough to allow passage of T-nut barrel 171. The rim of the barrel is offset below the upper clamp portion top surface to provide clearance during tightening of the cap screw 141. The cap screw head 147 engages the top surface during the tightening step. As noted, the rear clamp 154 is configured identically to the front clamp 153.

Installation

Prior to installing tag engagement member 20, or the alternative bilateral embodiment depicted in FIGS. 15–23 into the surfboard 104, recess 92 is formed in the underside 96 of the surfboard. The outline of the recess corresponds closely to the top plan profile of the tag engagement member (less the outriggers). At least one, and preferably two or more, transverse bores 94 are formed in the surfboard core 102. The transverse bores extend from a side edge of the board through the surfboard core into the surfboard recess 92. The bores preferably extend past the recess a short distance toward the centerline of the board as shown in the FIG. 4. When filled with cured resin, the transverse bores provide reinforcement for the tag engagement member and prevent dislodging of the tag engagement member after installation. It is to be appreciated, however, that installation of the tag engagement member could be accomplished without the resin-filled bores. Also, other transverse support members could be used such as wood, plastic or light alloy stringers.

For assembly of the tag engagement member, socket 16 is snap-fit onto plug 18 by urging the plug structure into socket cavity 41 until base shoulder 26 on the plug contacts socket bottom 95. Simultaneously, ridges 40*a*, 40*b* become frictionally engaged to the interior of the socket cavity to thereby fix the plug within the cavity. In a similar manner, the bilateral plug 150 of FIG. 19 is inserted into the cavity 139 on the underside of the bilateral socket 135, (FIG. 23) according to the orientation of FIG. 19, thereby forming a bilateral tag engagement member 175. When properly inserted, the cross-slot plug pin guides 137, 138 formed in the bilateral socket 135 will align with the first and second pin insertion slots 161, 162 formed in the bilateral plug 150. Similarly, the cap screw openings 140 will align with the holes 176 formed in the upper clamp portions 157 of the front and rear clamps 153, 154.

Prior to placing the assembled bilateral tag engagement member 175 within the recess 92 of the sport board 104, the barrels 171 of the two T-Nuts must be respectively inserted into the barrel guides 174 and the nut base 170 of each T-nut 169 securely oriented in its respective countersink 172 to prevent the nut from rotating when a cap screw 141 is tightened within the threaded barrel 171. To ensure that the nut base 170 does not fall out of its respective countersink 172 when being lowered into the sport board recess 92, embodiments are envisioned wherein a contact adhesive secures each of the T-nuts 169 in place.

FIG. 23 shows a bottom plan view of the bilateral socket 135 of FIG. 19, illustrating the lower cavity 139 into which the bilateral plug is inserted. The inner surface 178 of the cavity conforms to the outline of base 151 of the bilateral plug 150.

After the plug 150 and socket 135 have been assembled to form the bilateral tag engagement member, the bilateral tag engagement member 175 is placed within the surfboard recess 92. The surfboard recess must have sufficient depth so that when this is accomplished, the outriggers 145 will rest on the underside of the board, thereby controlling the depth to which the tag engagement member 175 will descend into the recess 92. According to the preferred depth and orientation, the bilateral tag engagement member 175 will be suspended and spaced-apart from the bottom and sides of recess 92. This is best seen in FIGS. 5–8 for a standard tag engagement member 20, and FIGS. 20–21 for a bilateral tag engagement member 175, the assembly of which are very similar. Optionally, as noted above and shown in FIG. 7, the tag engagement member can be placed in the surfboard recess and canted at an angle $\sigma$. These same options are available with a single side tag engagement member 20 and the bilateral tag engagement member 175 of FIGS. 15–23.

With the tag engagement member 20, 175 positioned as desired, resin 98 is poured around the tag engagement member so that it fills the transverse bores, all notches, grooves and the portion of the surfboard recess not occupied by the tag engagement member. Thereafter, the resin is allowed to cure for a predetermined time as is known in the art. The resin and socket may have different, contrasting colors to facilitate the sand-off process and to enhance visibility of fingers 82 during fin installation and adjustment.

Figure 9:
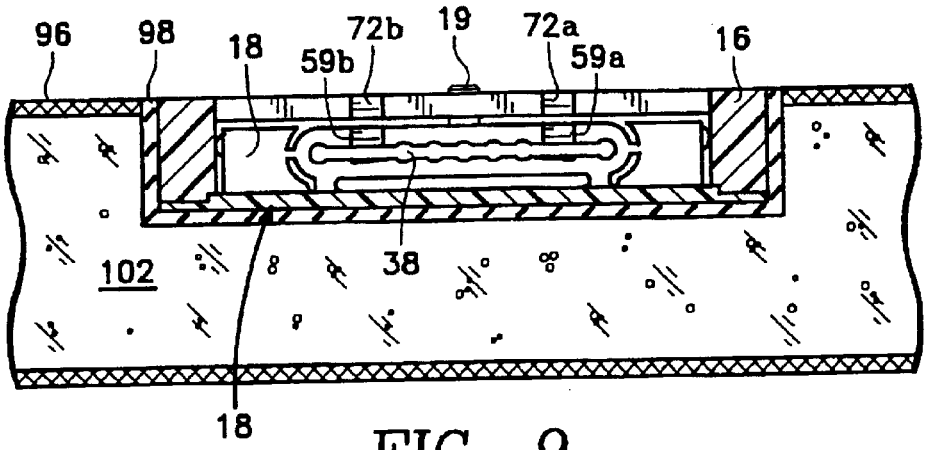
FIG. 9 is a view similar to FIG. 5, with the surfboard recess filled with resin and the resin barrier and indicator pegs sanded down after installation so that the tag engagement member outer surfaces are co-planar with the surfboard underside.
Figure 10:
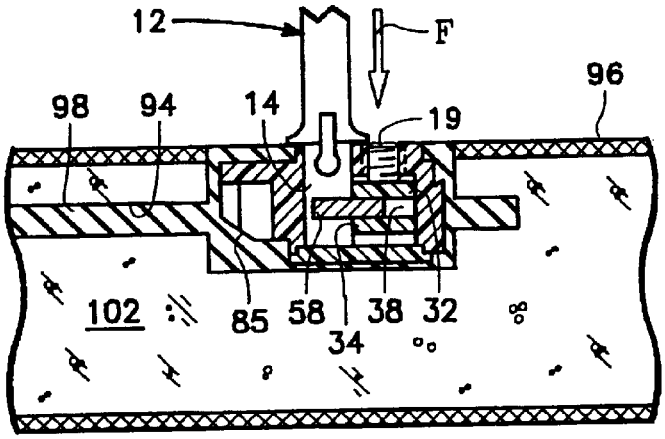
FIG. 10 is a view similar to FIG. 8, with the surfboard recess filled with resin and further illustrating the manner in which the surfboard tag and pin cooperate with the tag engagement member.

After the resin has cured, the underside of the board is sanded until all excess resin is removed and the surface of top wall 66 is co-planar with a plane defined by the underside surface 96 of the board. During this process, the resin barrier 76, 146, outriggers 84, 145 and indicator pegs 80 became removed from the tag engagement member. This is best seen in FIGS. 9, 10 and 14. Preferably, indicator pegs 80 are also formed with a color that contrasts with the resin so that it is easy to determine when sanding is complete. Otherwise, it is possible to oversand the board and form an unwanted depression in the underside of the board. Once the board has been sanded, the surfboard (with the embedded tag engagement member) is ready for operation. Although some of the structures such as the indicator pegs 80 and locator fingers 82 of FIG. 1 are not depicted in the embodiment of FIGS. 15–23, those skilled in the art will recognize that many of these structures can also be formed on the bilateral socket 135.

FIG. 20 is an illustration of a tag engagement member 175 that has been successfully inserted into a sportboard 104. The region between the sportboard recess 92 in the underside 96 of a sportboard and the outer surface of the bilateral socket 135 is filled with resin during fabrication. The outer diameter of the bilateral socket 135 is defined by the exterior socket walls 144 of FIG. 19. The final sanding serves to remove the outriggers 145 still present in FIG. 20, and fashion the surface of the socket flush with the underside surface 96 of the sportboard 104.

With respect to FIGS. 21 and 22, outriggers 145 are resting against the surface underside 96 of the sportboard, thereby controlling the depth to which the tag engagement member 175 extends into the recess 92. The spaces 177 between the tag engagement member 175 and the sportboard core 102 are filled with resin, epoxy, cement, or some any other suitable securing material. Hollow areas to be filled with resin surrounding the tag engagement member 175 are shown to have side resin thickness RT1 and RT3 and a bottom resin thickness RT2. The outriggers 145 and resin wall 146 on FIG. 21 have not been sanded. The resin barrier 146 in FIG. 22 is shown extending a height h3 off the underside surface 96 of the sportboard. This resin barrier 146 prevents resin from falling into the tag slot 136 during installation. After the resin has cured, the outriggers 145 and resin barrier 146 are sanded flush with the underside surface 96 of the sportboard 104.

Operation

A fin-and-tag unit 100 is attached to a sport board 104 according to the following steps. If cap screws 141 are already tightened within the T-nuts 169, they are loosened to allow the lower clamp portion 158 and upper clamp portion 157 to return to their natural position. The user then aligns the bilateral tag 103 above tag slot 136 of the bilateral socket 135. Next, the bilateral tag-pin 105 is aligned above a selected right or left cross-slot pin guide 137, 138. Next, the bilateral tag 103 is inserted into the slot 136, causing the bilateral tag-pin 105 to pass through the selected cross-slot pin guides 137, 138 and through the corresponding pin-insertion slot 161, 162. The insertion continues until opposing ends of the bilateral tag-pin 105 respectively engage the upper surface of the lower clamp portions 158 of the front and rear clamps 153, 154.

The bilateral tag 105 is then slid laterally within the tag slot 155 until the ends of the bilateral tag pin 106 are oriented in a preferred groove 168. In the next step, the cap screws 141 are then tightened in the threaded T-nut barrels 171. This action flexes the upper clamp portion 157 toward the lower clamp portion 158, thereby frictionally securing the ends of the bilateral tag pin 105 within the selected groove 168 of the respective pin slots 159 of the front and rear clamps 153, 154. This action will also simultaneously flex the lower clamp portion 158 downward toward the upper surface 165 of the base 151. The flexure creates a tension in the flexible anti-torsion suspension members 119, 120 that is transmitted into the respective end portions 152*a,b*.

The tension in the flexible anti-torsion suspension members and flexure of the upper clamp portion produces an upward force (according to the orientation of FIG. 19) of the upper clamp portion 157 against the cap screw heads 147 and a downward force of the base 151 against the T-nut bases 170. These opposing forces produces perpendicular shear forces between the threads within the threaded shafts 148 and the threads on the threaded barrels 171, thereby inhibiting the loosening of cap screws 141 and producing a "lock-washer effect."

Another advantage of the above construction is the distribution of force it creates. The tension in the flexible anti-torsion suspension members is exerted through the end portions 152*a,b* and into the plug base 151, acting to bow the ends of the base 151 upward. This, in effect, acts to bow the center area of the base 151 (proximate the countersink 172) downward. In an opposite manner, the pulling of the T-nut base 170 upward against the plug base 151 acts to bow the center area of the base 151 upward. This in turn creates a compressive force running laterally through the base 151 between the center area of the base 151 and the respective opposing base ends. This compressive force thereby reduces the shear force that would otherwise be imparted to the base 151 adjacent the counter sinks 172 by the upward pull of the T-nut bases 170. As discussed above, the same operational engagement of elements and distribution of force also occurs in the rear clamp 154.

Lateral forces on a fin 101 can be exerted in either direction during use. By extending a bilateral tag pin 105 across both sides of the upstanding plane of the fin 101, and securing the bilateral tag-pin 105 with front and rear clamps secured by respective cap screws 141, the bilateral embodiment of the claimed invention resists lateral forces impinging on a fin from either direction.

If the board has been oversanded, the lower clamp portion 34 will also flex into compensation slot 64 until it abuts against upraised plug base portion 24. This will provide a counterforce and insure a strong securement of the tag pin 58 to the pin slot 38.

If the user wishes to change the position of the fin, the cap screw is loosened until the upper clamp portion 32 and lower clamp portion 34 are disengaged from the tag pin. Then, the fin may be moved forward or backward until it is located in a new desired position. Thereafter, cap screw is re-tightened to cause the sequence of actions described above. For removal, the cap screw is loosened and pin 58 is moved longitudinally until it is aligned with pin channel 59*a* and cut-out area 72*a*. The fin may then be pulled outward to remove the tag from the tag slot. An identical process allows the adjustment or disengagement of a bilateral tag 118 from a bilateral socket 135.

While the particular surfboard fin attachment assembly shown and disclosed herein is fully capable of obtaining the objects and providing the advantages above stated, it is to be understood that the presently preferred embodiments are merely illustrative of the invention. As such, no limitations are intended other than as defined in the appended claims.

What is claimed is:

1. A sportboard assembly comprising:

a) a sportboard with a with bilateral tag engagement unit;

b) a tag fixed to a fin, said tag comprising:

i) a first side and an opposing second side; and ii) a bilateral tag pin having a first end extending outwardly from said first side and a second end extending outwardly from said second side; said first end and said second end being simultaneously engaged to said bilateral tag engagement unit; and c) said bilateral tag engagement unit having a first clamp for securing said first end, and a second clamp for securing said second end.

2. The sportboard assembly according to claim 1 wherein the tag and the fin are integrally formed into a unitary member.

3. The sportboard assembly according to claim 1 wherein the sportboard has a longitudinal axis, and said tag-pin extends about perpendicularly to the longitudinal axis.

4. The sportboard assembly according to claim 1 further comprising a first tightening means for controllably imparting a first force to said first clamp, and a second tightening means for controllably imparting a second force to said second clamp.

5. The sportboard assembly according to claim 4 wherein said first clamp and said second clamp are connected to a respective first suspension members and second suspension member.

6. The sportboard of claim 5 wherein said bilateral tag engagement unit includes a plug base from which extends a first end part and an opposing second end part, each of said first and second supporting members being connected to a respective first and second end part.

7. The sportboard of claim 4 wherein said first clamp and said second clamp each comprises an upper clamp portion and a lower clamp portion which are each spaced-apart by a closed tag slot.

8. The sportboard of claim 7 wherein said first and second tightening means interconnects said plug base with the upper clamp portion of respective first and second clamps.

9. The sportboard assembly according to claim 1 wherein said first clamp comprises an elongated upper clamp member and an elongated lower clamp member separated by a pin slot, said upper and lower clamp members having a plurality of opposing ridges and grooves for engaging said first end in a plurality of longitudinal positions.

10. The sportboard assembly according to claim 5 wherein said bilateral tag engagement unit has a plug-base with first and second barrel guide holes respectively disposed beneath said first and second clamps, the sportboard further comprising:

a) a first T-nut having a first T-nut-base secured to a first threaded barrel, said first T-nut base disposed below the plug-base, and said first threaded barrel extending through said first barrel guide hole; and b) a second T-nut having a second T-nut base secured to a second threaded barrel, said second T-nut base disposed below said plug base, and said second threaded barrel extending through said second barrel guide hole, wherein said first and second threaded shafts are threadably engaged with said first and second threaded barrel respectively.

11. The improved sportboard according to claim 5 wherein said suspension members exert a continual force on said first clamp, resulting in a lock washer effect on an engagement between said first threaded shaft and said first threaded barrel.

12. The improved sportboard according to claim 9 further comprising a first securing member coupled to the first clamp and configured to releasably secure the first tag pin within a predetermined groove, such that when the first securing member is released, the first tag pin can be slidably adjusted to any groove within the first pin slot, and when the first securing member is secured, the first tag pin is secured in a predetermined groove within the first pin slot.

13. The improved sportboard according to claim 12 further comprising a second securing member coupled to the second clamp and configured to releasably secure the second tag pin within a predetermined groove, such that when the second securing member is released, the second tag pin can be slidably adjusted within the second pin slot, and when the second securing member is secured, the second tag pin is secured in a predetermined groove within the second pin slot.

14. The improved sportboard according to claim 12 wherein the first securing member and the second securing member include first and second cap screws.

15. The improved sportboard according to claim 1 further comprising a center channel separating said first clamp from said second clamp, said center channel being of a length and width sufficient for insertion of said tag in said center channel, and wherein a) said tag is tapered; and, b) surfaces of said first and second clamp that face the center channel are tapered to snugly receive said tapered tag.

16. The improved sportboard according to claim 15 comprising at least one pin slot intersecting said center channel, said pin slot being sufficient size to allow passage of said tag-pin.

17. The improved sportboard according to claim 1 wherein the tag engagement member includes a bilateral plug and a bilateral socket having a cavity into which the bilateral plug is fitted, and wherein the bilateral plug is a single contiguous member including said first clamp and said second clamp.

18. A method of releasably securing a fin with a tag to a sport board with a tag engagement member having a first flexible clamp with a first pin slot and a second flexible clamp with a second pin slot, the tag engagement member including a center slot in communication with said first and second pin slots, said tag having a first side from which extends a tag-pin first end, a second side from which extends a tag-pin second end, the method comprising the steps:

a) moving inserting said tag through into said center slot until said first and second ends enter into a respective first and second pin slot;

b) moving said tag laterally until said first and second ends are at a selected position in a respective first and second pin slot; and c) securing said first and second ends of said tag-pin within said tag engagement member by flexing said first and second clamps against each respective corresponding first and second end.

19. The method according to claim 18 wherein said tag engagement member has a base and said first clamp is coupled to a first cap screw threadably engaged with a first T-nut, and said second clamp is coupled to a second cap screw threadably engaged with a second T-nut, said first and second T-nuts being coupled to said base, the step of flexing said first and second clamps comprising the steps of:

a) tightening said first cap screw into said first T-nut; and, b) tightening said second cap screw into said second T-nut.

20. The method according to claim 19 wherein the selected position is defined by a groove abutted by ridges.

21. The method according to claim 18 wherein the fin sportboard and the tag are comprised of a single contiguous member.

22. The method according to claim 19 wherein each one of said first and second clamps have a respective first and second upper clamp portion, said first and second cap screws being in engagement with a respective first and second upper clamp portion.

* * * * *